US009671709B2

(12) United States Patent
Sun et al.

(10) Patent No.: US 9,671,709 B2
(45) **Date of Patent: *Jun. 6, 2017**

(54) CHEMICALLY PREPARED CORE SHELL TONER FORMULATION INCLUDING A BORAX COUPLING AGENT AND A PLASTICIZING AGENT IN THE CORE

(71) Applicant: Lexmark International, Inc., Lexington, KY (US)

(72) Inventors: Jing Sun, Lexington, KY (US); Kasturi Rangan Srinivasan, Longmont, CO (US); John Joseph Kraseski, Lexington, KY (US); Trent Duane Peter, Johnstown, CO (US); Walter Mychajlowski, Superior, CO (US); Tao Yu, Wellesley, MA (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 13 days.

This patent is subject to a terminal disclaimer.

(21) Appl. No.: 14/145,043

(22) Filed: Dec. 31, 2013

(65) Prior Publication Data

US 2016/0154333 A1 Jun. 2, 2016

(51) Int. Cl.
*G03G 9/093* (2006.01)

(52) U.S. Cl.
CPC ..... *G03G 9/09371* (2013.01); *G03G 9/09328* (2013.01); *G03G 9/09342* (2013.01); *G03G 9/09392* (2013.01)

(58) Field of Classification Search
USPC ..... 430/108.1, 109.3, 109.4
See application file for complete search history.

(56) References Cited

U.S. PATENT DOCUMENTS

| | | | | |
|---|---|---|---|---|
| 5,659,858 | A * | 8/1997 | Kunugi | G03G 9/08 399/252 |
| 9,023,569 | B2 * | 5/2015 | Sun | G03G 9/09328 430/108.1 |
| 9,217,939 | B2 * | 12/2015 | Srinivasan | G03G 9/09725 |
| 2009/0087765 | A1 * | 4/2009 | Kidokoro | G03G 9/0819 430/108.1 |
| 2011/0065038 | A1 * | 3/2011 | Sacripante | G03G 9/0819 430/108.4 |
| 2011/0177444 | A1 * | 7/2011 | Mattison, Jr. | G03G 9/0821 430/108.3 |
| 2012/0258392 | A1 * | 10/2012 | Murata | G03G 9/0804 430/105 |

* cited by examiner

*Primary Examiner* — Peter Vajda

(57) ABSTRACT

A chemically prepared toner composition according to one example embodiment includes a core including a first polymer binder, a second polymer binder, a colorant and a release agent; a shell that is formed around the core and includes a third polymer binder; and a borax coupling agent between the core and the shell. The first and third polymer binders are different amorphous polyester resins. The second polymer binder is a crystalline polyester resin and acts as a plasticizing agent in the core. The borax coupling agent assists in adhering the shell to the outer surface of the core. Optionally, the toner of the present invention may be finished with a set of extra particulate additives.

12 Claims, No Drawings

CHEMICALLY PREPARED CORE SHELL TONER FORMULATION INCLUDING A BORAX COUPLING AGENT AND A PLASTICIZING AGENT IN THE CORE

CROSS REFERENCES TO RELATED APPLICATIONS

This patent application is related to U.S. patent application Ser. No. 13/339,705, filed Dec. 29, 2011, entitled "Chemically Prepared Toner Formulation Including a Borax Coupling Agent", and assigned to the assignee of the present application.

BACKGROUND

Field of the Disclosure

The present invention relates generally to chemically prepared toner having a core shell structure for use in electrophotography and more particularly to emulsion aggregation chemically prepared toner including a borax coupling agent located on the surface of the core and a plasticizing agent located within the core of the toner.

Description of the Related Art

Toners for use in electrophotographic printers include two primary types, mechanically milled toners and chemically prepared toners (CPT). Chemically prepared toners have significant advantages over mechanically milled toners including better print quality, higher toner transfer efficiency and lower torque properties for various components of the electrophotographic printer such as a developer roller, a fuser belt and a charge roller. The particle size distribution of CPTs is typically narrower than the particle size distribution of mechanically milled toners. The size and shape of CPTs are also easier to control than mechanically milled toners.

There are several known types of CPT including suspension polymerization toner (SPT), emulsion aggregation toner (EAT)/latex aggregation toner (LAT), toner made from a dispersion of pre-formed polymer in solvent (DPPT) and "chemically milled" toner. While emulsion aggregation toner requires a more complex process than other CPTs, the resulting toner has a relatively narrower size distribution. Emulsion aggregation toners can also be manufactured with a smaller particle size allowing improved print resolution. The emulsion aggregation process also permits better control of the shape and structure of the toner particles which then allows the toner particles to be tailored to fit the desired cleaning, doctoring and transfer properties. The shape of the toner particles produced from an EA process may be optimized to ensure proper and efficient cleaning of the toner from various electrophotographic printer components, such as the developer roller, charge roller and doctoring blades, in order to prevent filming or unwanted deposition of toner on these components.

In a typical process for preparing EAT, emulsion aggregation is carried out in an aqueous system resulting in good control of both the size and shape of the toner particles. The toner components typically include a polymer binder, one or more colorants and a release agent. A styrene-acrylic copolymer polymer binder is often used as the latex binder in the emulsion aggregation process. However, the use of a styrene-acrylic copolymer latex binder requires a tradeoff between the toner's fusing properties and its shipping and storage properties. One important characteristic of any toner is its fuse window. The fuse window is the range of temperatures at which fusing is satisfactorily conducted without incomplete fusion and without transfer of toner to the heating element, which may be a roller, belt or other member contacting the toner during fusing. Thus, below the low end of the fuse window the toner is incompletely melted and above the high end of the fuse window the toner flows onto the fixing member where it mars subsequent sheets being fixed. It is preferred that the low end of the fuse window be as low as possible to reduce the required temperature of the fuser in the electrophotographic printer to therefore improve the printer's safety and to conserve energy.

However in addition to fuse at an energy saving low temperature, the toner must also be able to survive the temperature and humidity extremes associated with storage and shipping—commonly called the ship/storage test. Caking or blocking of the toner during shipping and storage usually results in print flaws. Energy saving low fusing toner is desirable but the low end of the fuse window cannot be so low that the toner melts during the storing or shipping of a toner cartridge containing the toner. A low melt/low energy fusing toner must be robust to shipping and storage conditions in order to be attractive in a worldwide market. However, many toner formulations cannot simultaneously meet the demand to fuse at low temperatures while also passing the ship/storage tests.

Toners formed from polyester binder resins typically possess better mechanical properties than toners formed from a styrene-acrylic copolymer binder of similar melt viscosity characteristics. This makes them more durable and resistant to filming of printer components. Polyester toners also have better compatibility with color pigments resulting in a wider color gamut. Until recently, polyester binder resins were frequently used in preparing mechanically milled toners but rarely in chemically prepared toners. Polyester binder resins are manufactured using condensation polymerization. This method is time consuming due to the involvement of long polymerization cycles and therefore limits the use of polyester binder resins to polyester polymers having low to moderate molecular weights, which limits the fusing properties of the toner. Further, polyester binder resins are more difficult to disperse in an aqueous system due to their polar nature, pH sensitivity and gel content thereby limiting their applicability in the emulsion aggregation process.

However with advancement in toner manufacturing technology, many toner manufacturers are now using polyester resins rather than styrene acrylic resins because it has become possible to obtain stable polyester emulsions. These stable emulsions are formed using polyester binder resins by first dissolving them in an organic solvent, such as methyl ethyl ketone (MEK), methylene chloride, ethyl acetate, or tetrahydrofuran (THF), and then performing a phase-inversion process where water is added slowly to the organic solvent. The organic solvent is then evaporated to allow the polyester binder resins to form stable emulsions. U.S. Pat. No. 7,939,236 entitled "Chemically Prepared Toner and Process Therefor," which is assigned to the assignee of the present application and incorporated by reference herein in its entirety teaches a similar process for obtaining a stable polyester emulsion using an organic solvent. These advances in producing stable polyester emulsions have permitted the increased use of polyester binder resins to form emulsion aggregation toner. For example, U.S. Pat. No. 7,923,191 entitled "Polyester Resin Produced by Emulsion Aggregation" and U.S. patent application Ser. No. 12/206,402 entitled "Emulsion Aggregation Toner Formulation," which are assigned to the assignee of the present application and incorporated by reference herein in their entirety, disclose processes for preparing emulsion aggregation toner using polyester binder resins.

However, simple switching from a styrene-acrylate resin to a to polyester resin in an EA toner formulation does not completely meet the challenges of providing a toner formulation that is energy efficient and survive shipping and storage concerns while providing great print quality. Unfortunately, toners having low molecular weight polyester resins do not significantly open the low temperature end of the fuse window to allow the toner to be energy efficient. Moreover due to its short chain migration speed, the amount of the polyester resin must be limited in the toner formulation in order for the toner to survive the temperatures and humidity extremes when being shipped and stored. The inventors of the present invention believe that lower fusing temperatures in a toner can be achieved by the addition of plasticizing agents into the toner formulation. Any ideal plasticizing agent must possess not only low melting temperatures, but also have a sufficiently low melt flow viscosity to enable the toner to penetrate into paper fibers thereby giving the toner good fixation under such low melting temperatures. Also the plasticizing agent must provide enough filming strength to withstand the lifting/peeling actions at higher printing speeds at the operational temperature range of the electrophotographic printer. Unfortunately, most of the known plasticizing agents are low molecular weight organic compounds or polymers and tend to migrate to the surface of the toner during the manufacture of the toner which negatively impacts the toner's ship/store properties.

Accordingly, it will be appreciated that a toner formulation and process that can simultaneously fuse at an energy saving low temperature in addition to survive shipping and storage concerns while providing good print quality is desired. It is also desired to minimize the overall number of fine toner particles, which contribute to filming on the printer components.

SUMMARY

A chemically prepared toner composition according to one example embodiment includes a core including a first and second polymer binder, a colorant and a release agent; a shell including a third polymer binder that is formed around the core; and a reversible borax coupling agent added to the outer surface of the core during the process of making the toner of the present invention. Preferably the third polymer binder in the shell is an amorphous polyester resin having a high glass transition temperature of at least 55° C. The second polymer binder in the core is a crystalline polyester resin which acts as a unique plasticizing agent within the core. Moreover, the glass transition temperature (Tg) and the melt temperature (Tm) of the polyester resin in the shell must be higher than the Tg and Tm of the polymer binder in the core. The melting point of the crystalline polyester is preferred in the range from 70° C. to 100° C., more preferably about 80° C. to fuse at low temperatures while simultaneously maintain ship/store stability.

DETAILED DESCRIPTION

The art to practice the present invention. It is to be understood that the disclosure is not limited to the details of construction and the arrangement of components set forth in the following description or illustrated in the drawings. The invention is capable of other embodiments and of being practiced or of being carried out in various ways. For example, other embodiments may incorporate structural, chronological, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense and the scope of the present invention is defined by the appended claims. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The present disclosure relates to an emulsion aggregation chemically prepared toner composition having a core including a first and second polymer binder, a colorant and a release agent. A shell including a third polymer binder is formed around the core. A borax reversible coupling agent is added to the outer surface of the core during the process of making the toner of the present invention. As used herein, the term borax coupling agent is defined as enabling the formation of hydrogen bonds between polymer chains which assists in the anchoring or binding of the third polymer found in the shell onto the outer surface of the toner core containing the first and the second polymers, thereby helping to couple the shell to the outer surface of the toner core. After the borax coupling agent is added to the outer surface of the core, the shell is placed around the outer surface of the core. Consequently it can be appreciated that the borax coupling agent is between the outer surface of the toner core and the shell in the final toner particle. The second polymer binder in the core is a crystalline polyester resin which acts as a unique plasticizing agent after melting within the core. Moreover, the glass transition temperature (Tg) and the melt temperature (Tm) of the polymer binder in the shell must be higher than the Tg and Tm of the polymer binder in the core. The polymer binder in the shell is a polyester type resin, preferably an amorphous polyester resin having a high Tg of at least 55° C.

The toner may be utilized in an electrophotographic printer such as a printer, copier, multi-function device or an all-in-one device. The toner may be provided in a cartridge that supplies toner to the electrophotographic printer. Example methods of forming toner using conventional emulsion aggregation techniques may be found in U.S. Pat. Nos. 6,531,254, 6,531,256, and US Pub. No. 2013/0171551, which are assigned to the applicants of the present invention and are incorporated by reference herein in their entirety.

In the present emulsion aggregation process, the toner particles are provided by chemical methods as opposed to physical methods such as pulverization. Generally, the toner includes one or more polymer binders, a release agent, a colorant, a reversible borax coupling agent and one or more optional additives such as a charge control agent (CCA). Two different amorphous polyesters are used in the core and shell, respectively. A crystalline polyester resin having certain properties is used as the plasticizing agent in the core. The inventors have discovered that the crystalline polyester resin must possess certain properties to produce a final toner that can simultaneously fuse at a low temperature and maintain ship/storage properties. Emulsions of the chosen polymer binders are formed in water, optionally with organic solvent, with an inorganic base such as sodium hydroxide, potassium hydroxide, ammonium hydroxide, or an organic amine compound. A stabilizing agent having an anionic functional group (A−), e.g., an anionic surfactant or an anionic polymeric dispersant may also be included. It will be appreciated that a cationic (C+) functional group, e.g., a cationic surfactant or a cationic polymeric dispersant, may be substituted as desired.

Amorphous polymer latexes are used at two points during the toner formation process. The first amorphous polymer latex with a low Tg is used to form the core containing the crystalline polyester emulsion, and a second different polymer latex with high Tg is used to form a shell around the toner core. The ratio of the amount of polymer emulsions in the toner core to the toner shell is between about 20:80 (wt.) and about 80:20 (wt.) including all values and increments there between, such as between about 50:50 (wt.) and about 70:30 (wt.). The ratio of the crystalline polyester resin to the amorphous polyester resin is between 3:97 to 20:80 (wt.) including all values and increments there between, preferably between 4:96 and 8:92. The colorant, release agent, and the optional charge control agent are dispersed separately in their own aqueous environments or in one aqueous mixture, as desired, in the presence of a stabilizing agent having similar functionality (and ionic charge) as the stabilizing agent employed in the polymer latex. The polymer latexes forming the toner core, the release agent dispersion, the colorant dispersion and the optional charge control agent dispersion are then mixed and stirred to ensure a homogenous composition. As used herein, the term dispersion refers to a system in which particles are dispersed in a continuous phase of a different composition (or state) and may include an emulsion. Acid is then added to reduce the pH and cause flocculation. Flocculation refers to the process by which destabilized particles conglomerate (due to e.g., the presence of available counterions) into relatively larger aggregates. In this case, flocculation includes the formation of a gel where resin, colorant, release agent and charge control agent form an aggregate mixture, typically from particles 1-2 microns (μm) in size. Unless stated otherwise, reference to particle size herein refers to the largest cross-sectional dimension of the particle. The aggregated toner particles may then be heated to a temperature that is less than or around (e.g., ±5° C.) the glass transition temperature (Tg) of the amorphous polymer latex in the core to induce the growth of clusters of the aggregate particles. Once the aggregate particles reach the desired size of the toner core, the reversible borax coupling agent is added so that it is on the outer surface of the toner core during the process of making the toner. Following the addition of the borax coupling agent, the polymer latex forming the toner shell is added. This polymer latex aggregates around the toner core and the borax on the outer surface of the toner core to form the toner shell. Once the aggregate particles reach the desired toner size, base may be added to increase the pH and reionize the anionic stabilizing agent to prevent further particle growth or one can add additional anionic stabilizing agents. The temperature is then raised above the glass transition temperature of the polymer latex(es) to fuse the particles together within each cluster. This temperature is maintained until the particles reach the desired circularity. The toner particles are then washed and dried.

The toner particles produced may have an average particle size of between about 3 μm and about 20 μm (number average particle size) including all values and increments there between, such as between about 4 μm and about 15 μm or, more particularly, between about 5 μm and about 7 μm. The toner particles produced may have an average degree of circularity between about 0.90 and about 1.00, including all values and increments there between, such as about 0.93 to about 0.98. The average degree of circularity and average particle size may be determined by a Sysmex Flow Particle Image Analyzer (e.g., FPIA-3000) available from Malvern Instruments. It can be appreciated that the boron coupling agent is part of the final toner particles.

The various components for the emulsion aggregation method to prepare the above referenced toner will be described below. It should be noted that the various features of the indicated components may all be adjusted to facilitate the step of aggregation and formation of toner particles of desired size and geometry. It may therefore be appreciated that by controlling the indicated characteristics, one may first form relatively stable dispersions, wherein aggregation may proceed along with relatively easy control of final toner particle size for use in an electrophotographic printer or printer cartridge.

Polymer Binders

The terms resin and polymer are used interchangeably herein as there is no technical difference between the two. The toner contains at least three different types of polyester resins. The first polyester resin used is a crystalline polyester resin which is used as the plasticizer in the toner. To satisfy the ship-store stability of the toner, a crystalline polyester resin must have a melting temperature (Tm) at least 20° C. above the required ship-store environmental temperature of 50° C. However, a crystalline polyester resin having too high a Tm will not function well as a plasticizer together with the amorphous resins used in toner. It is also worth noting that studies surprisingly indicate that a crystalline polyester resin having a low Tm of about 70° C. to about 80° C. is more effective in improving the low temperature fusing property of the toner, even at same level of loading of the crystalline polyester having a higher Tm. Unfortunately, a crystalline polyester resin having too low a Tm could be completely melted during the EA-CPT process and lose its' crystallinity. Once its' crystallinity disappears, the crystalline polyester resin will act like any other low molecular weight plasticizer and migrate to the toner surface and sabotage the ship-store property of the toner. Moreover, using certain low Tm crystalline polyester resins complicates the toner making process, as well as increasing the fine particles of the resulting toner. The inventors have determined that the optimum Tm for the crystalline polyester resin to be used as the plasticizing agent in the core is about 70° C. to about 90° C.

In addition to the above listed Tm requirements of the crystalline polyester, the reaction temperature used in the EA CPT process must be set to be above the glass transition temperature of the amorphous polyester resin, and not high above the Tm of the chosen crystalline polyester resin to be used as the plasticizing agent. More specifically the inventors have discovered to produce a toner that can simultaneously fuse at a low temperature, passes all shipping and storage tests and provide great print quality, the reaction temperature set for the EA CPT process is preferably around 70° C. to 90° C., most preferably between 80° C. to 85° C. and the Tm of the crystalline polyester resin should also be within the range of 70° C. to 90° C., most preferably between 80° C. to 85° C.

In addition to a specific range of the melting temperature for the crystalline polyester resin discussed above, the quantity and the chemistry of the crystalline polyester resin used are crucial to provide the desirable characteristics of the toner. Having too much a quantity of low Tm crystalline resin in the toner composition not only lowers the fusing temperature, but also makes the toner particles so soft that deformation of the toner shape occurs, and further hurts the toner's ship-store properties. The quantity of low Tm crystalline polyester resin to be used in the toner formulation of the present invention is between 3%-20% (wt) of the polyester resin component in the toner composition, most preferably between 4%-8%.

While the Tm of the crystalline polyester resin is important to achieve the desirable low temperature fusing and ship-store properties of the toner, the chemistry of the crystalline polyester resin is also important. As mentioned above, the crystallinity in the polymer comes from the packing and secondary force of the structure of the polymer. The molecular packing of the crystalline polyester will also affect the interaction of the crystalline polyester with the amorphous polyester used in the core of the toner. Crystalline polyesters can be made from a variety of monomers selections. For example, its di-ol selection could come from 1,6-hexanediol, 1,5-pentanediol, 1,9-nonanediol, and even longer carbon chains. Its di-acid can be selected from fumaric acid, adipic acid, sebacic acid, and even terephthalic acid. The interaction of the crystalline polyester with the amorphous polymer in the core plays a vital role in having acceptable low fusing temperatures and ship-store properties.

A crystalline polyester resin only containing a fumaric acid monomer was tested in an EA CPT toner but unfortunately no crystallinity or semi-crystallinity effect was observed from this type of crystalline polyester resin. The inventors believe this is due to the fact that because the chain length of the linear hydrocarbon in a fumaric acid monomer is too short. Therefore it is preferred that a long chain di-alcohol and di-acid be present in the crystalline polyester. Long chain is defined as greater than 4 carbon atoms. It is believed that a crystalline polyester resin having this long chain entanglement helps to maintain the structure of the crystalline polyester resin, thereby reducing its migration to the toner shell and improves the ship-store performance. Various commercially available crystalline polyester resin emulsions meeting the above requirements are available from Kao Corporation, Bunka Sumida-ku, Tokyo, Japan and Reichhold Chemical Company, Durham, N.C. under the trade names EPC 2-20, EPC 3-20, 6-20, 7-20, CPES B1, EPC 8-20, EPC 9-20, EPC-10-20, CPES B20, CPES B25 and EM192692.

The preferred amorphous polyester resin to be used in the core and shell of the toner in the present invention can be linear or slightly crosslinked. Such light crosslinking will significantly improve the hot offset resistance of the toner. The preferred Tg of the amorphous polyester to be used in the core is between 50° C.-60° C. The preferred Tm of the amorphous polyester to be used in the core is between 90° C.-110° C. The preferred Tg of the amorphous polyester to be used in the shell is between 60° C.-65° C. The preferred Tm of the amorphous polyester to be used in the shell is between 110° C.-140° C.

All resins used in the toner should have an acid value from 5 to 30. Emulsions of polyesters are formed in water, optionally with organic solvent, with an inorganic base such as sodium hydroxide, potassium hydroxide, ammonium hydroxide, or an organic amine compound. A stabilizing agent having an anionic functional group (A−), e.g., an anionic surfactant or an anionic polymeric dispersant may also be included. It will be appreciated that a cationic (C+) functional group, e.g., a cationic surfactant or a cationic polymeric dispersant, may be substituted as desired. The amorphous polymer latexes are used at two points during the toner formation process. The first amorphous polymer latex with the low Tg is used to form the core containing the crystalline polyester emulsion, and a second polymer latex with high Tg is used to form a shell around the toner core. The ratio of the amount of polymer emulsions in the toner core to the shell is between about 20:80 (wt.) and about 80:20 (wt.) including all values and increments there between, such as between about 50:50 (wt.) and about 80:20 (wt.). The ratio of the crystalline polyester resin to the total amorphous polyester resin is between 3:97 to 15:85 (wt.) including all values and increments there between. The polyester binder(s) may be formed using acid monomers such as terephthalic acid, trimellitic anhydride, dodecenyl succinic anhydride and fumaric acid. Further, the polyester binder(s) may be formed using alcohol monomers such as ethoxylated and propoxylated bisphenol A. Example amorphous polyester resins include, but are not limited to, T100, TF-104, NE-1582, NE-701, NE-2141, NE-1569, Binder C, FPESL-2, W-85N, TL-17, TPESL-10, TPESL-11 polyester resins from Kao Corporation, Bunka Sumida-ku, Tokyo, Japan, or mixtures thereof or Finetone 382ES or 382ES-HMW available from Reichhold Chemical Company, Durham, N.C.

Reversible Borax Coupling Agent

The coupling agent used herein is borax (also known as sodium borate, sodium tetraborate, or disodium tetraborate). As used herein, the term borax coupling agent is defined as enabling the formation of hydrogen bonds between polymer chains which assists in the anchoring or binding of the third polymer found in the shell onto the surface of the toner core containing the first and the second polymers, thereby helping to couple the shell to the outer surface of the toner core. The inventors have discovered that the addition of this unique coupling agent into the toner formulation helps the shell to adhere to the core, thereby creating a uniform particle size distribution toner and reducing the free shell particle formation. Typically, coupling agents have multivalent bonding ability. Borax differs from commonly used permanent coupling agents, such as multivalent metal ions (e.g., aluminum and zinc), in that its bonding is reversible based on the temperature and pressure. In the electrophotographic process, toner is preferred to have a low fusing temperature to save energy and a low melt viscosity ("soft") to permit high speed printing at low fusing temperatures. However, in order to maintain the stability of the toner during shipping and storage and to prevent filming of the printer components, toner is preferred to be "harder" at temperatures below the fusing temperature. Borax provides cross-linking through hydrogen bonding between its hydroxyl groups and the functional groups of the molecules it is bonded to. The hydrogen bonding is sensitive to temperature and pressure and is not a stable and permanent bond. For example, when the temperature is increased to a certain degree or stress is applied to the polymer, the bond will partially or completely break causing the polymer to "flow" or tear off. The reversibility of the bonds formed by the borax coupling agent is particularly useful in toner because it permits a "soft" toner at the fusing temperature but a "hard" toner at the storage temperature.

The inventors have also observed that borax surprisingly causes fine particles to collect on larger particles. As a result, borax is particularly suitable to used in the toner formulation between the core and shell layers of the toner because it collects the core components of the toner to the core particle before the shell is added thereby enhancing the core/shell layer separation, preventing the low molecular weight resin, pigment and wax accumulation in the shell which will result in an inferior fusing and ship/store properties, reducing the residual fine particles in the toner and controlling the charging property of the toner. It also reduces the amount of acid needed in the agglomeration stage and narrows the particle size distribution of the toner. Not to be bound by theory but the inventors believe that the borax has a detergent effect in the toner process, collecting the fine particles to the toner surface.

Borax also serves as a good buffer in the toner formation reaction as a result of the equilibrium formed by its boric acid and conjugate base. The presence of borax makes the reaction more resistant to pH changes and broadens the pH adjusting window of the reaction in comparison with a conventional emulsion aggregation process. The pH adjusting window is crucial in the industrial scale up of the process to control the particle size. With a broader window, the process is easier to control at an industrial scale.

The quantity of the borax coupling agent used herein can be varied. The borax coupling agent may be provided at between about 0.1% and about 5.0% by weight of the total polymer binder in the toner including all values and increments there between, such as between about 0.1% and about 1.0% or between about 0.1% and about 0.5%. If too much coupling agent is used, its bonding may not be completely broken at high temperature fusing. On the other hand, if too little coupling agent is used, it may fail to provide the desired bonding and buffering effects.

Colorant

Colorants are compositions that impart color or other visual effects to the toner and may include carbon black, dyes (which may be soluble in a given medium and capable of precipitation), pigments (which may be insoluble in a given medium) or a combination of the two. A colorant dispersion may be prepared by mixing the pigment in water with a dispersant. Alternatively, a self-dispersing colorant may be used thereby permitting omission of the dispersant. The colorant may be present in the dispersion at a level of about 5% to about 20% by weight including all values and increments there between. For example, the colorant may be present in the dispersion at a level of about 10% to about 15% by weight. The dispersion of colorant may contain particles at a size of about 50 nm to about 500 nm including all values and increments there between. Further, the colorant dispersion may have a pigment weight percent divided by dispersant weight percent (P/D ratio) of about 1:1 to about 8:1 including all values and increments there between, such as about 2:1 to about 5:1. The colorant may be present at less than or equal to about 15% by weight of the final toner formulation including all values and increments there between.

Release Agent

The release agent may include any compound that facilitates the release of toner from a component in an electrophotographic printer (e.g., release from a roller surface). For example, the release agent may include polyolefin wax, ester wax, polyester wax, polyethylene wax, metal salts of fatty acids, fatty acid esters, partially saponified fatty acid esters, higher fatty acid esters, higher alcohols, paraffin wax, carnauba wax, amide waxes and polyhydric alcohol esters.

The release agent may therefore include a low molecular weight hydrocarbon based polymer (e.g., Mn≤10,000) having a melting point of less than about 140° C. including all values and increments between about 50° C. and about 140° C. For example, the release agent may have a melting point of about 60° C. to about 135° C., or from about 65° C. to about 100° C., etc. The release agent may be present in the dispersion at an amount of about 5% to about 35% by weight including all values and increments there between. For example, the release agent may be present in the dispersion at an amount of about 10% to about 18% by weight. The dispersion of release agent may also contain particles at a size of about 50 nm to about 1 μm including all values and increments there between. In addition, the release agent dispersion may be further characterized as having a release agent weight percent divided by dispersant weight percent (RA/D ratio) of about 1:1 to about 30:1. For example, the RA/D ratio may be about 3:1 to about 8:1. The release agent may be provided in the range of about 2% to about 20% by weight of the final toner formulation including all values and increments there between.

Surfactant/Dispersant

A surfactant, a polymeric dispersant or a combination thereof may be used. The polymeric dispersant may generally include three components, namely, a hydrophilic component, a hydrophobic component and a protective colloid component. Reference to hydrophobic refers to a relatively non-polar type chemical structure that tends to self-associate in the presence of water. The hydrophobic component of the polymeric dispersant may include electron-rich functional groups or long chain hydrocarbons. Such functional groups are known to exhibit strong interaction and/or adsorption properties with respect to particle surfaces such as the colorant and the polyester binder resin of the polyester resin emulsion. Hydrophilic functionality refers to relatively polar functionality (e.g., an anionic group) which may then tend to associate with water molecules. The protective colloid component includes a water soluble group with no ionic function. The protective colloid component of the polymeric dispersant provides extra stability in addition to the hydrophilic component in an aqueous system. Use of the protective colloid component substantially reduces the amount of the ionic monomer segment or the hydrophilic component in the polymeric dispersant. Further, the protective colloid component stabilizes the polymeric dispersant in lower acidic media. The protective colloid component generally includes polyethylene glycol (PEG) groups. The dispersant employed herein may include the dispersants disclosed in U.S. Pat. No. 6,991,884 and U.S. Pat. No. 5,714,538, which are assigned to the assignee of the present application and are incorporated by reference herein in their entirety.

The surfactant, as used herein, may be a conventional surfactant known in the art for dispersing non self-dispersing colorants and release agents employed for preparing toner formulations for electrophotography. Commercial surfactants such as the AKYPO series of carboxylic acids from AKYPO from Kao Corporation, Bunka Sumida-ku, Tokyo, Japan may be used. For example, alkyl ether carboxylates and alkyl ether sulfates, preferably lauryl ether carboxylates and lauryl ether sulfates, respectively, may be used. One particular suitable anionic surfactant is AKYPO RLM-100 available from Kao Corporation, Bunka Sumida-ku, Tokyo, Japan, which is laureth-11 carboxylic acid thereby providing anionic carboxylate functionality. Other anionic surfactants contemplated herein include alkyl phosphates, alkyl sulfonates and alkyl benzene sulfonates. Sulfonic acid containing polymers or surfactants may also be employed.

Optional Additives

The toner formulation of the present disclosure may also include one or more conventional charge control agents, which may optionally be used for preparing the toner formulation. A charge control agent may be understood as a compound that assists in the production and stability of a tribocharge in the toner. The charge control agent(s) also help in preventing deterioration of charge properties of the toner formulation. The charge control agent(s) may be prepared in the form of a dispersion in a manner similar to that of the colorant and release agent dispersions discussed above.

The toner formulation may include one or more additional additives, such as acids and/or bases, emulsifiers, extra particular additives, UV absorbers, fluorescent additives, pearlescent additives, plasticizers and combinations thereof. These additives may be desired to enhance the properties of an image printed using the present toner formulation. For example, UV absorbers may be included to increase UV light fade resistance by preventing gradual fading of the image upon subsequent exposures to ultraviolet radiations. Suitable examples of the UV absorbers include, but are not limited to, benzophenone, benzotriazole, acetanilide, triazine and derivatives thereof.

Optionally, extra particular additives such as various sized silicas made also be added to the surface of the toner particle to improve its' flow. The toner of the present invention may then be treated with a blend of extra particulate agents, including medium silica sized 40 nm-50 nm, large colloidal silica sized equal to or greater than 70 nm, and optionally, alumina, small silica, and/or titania. Treatment using the extra particulate agents may occur in one or more steps, wherein the given agents may be added in one or more steps during the blending process.

Medium silica may be understood as silica having a primary particle size in the range of 30 nm to 60 nm, or between 40 nm to 50 nm, prior to any after treatment, including all values and increments therein. Primary particle size may be understood as the largest linear dimension through a particle volume. The medium silica may be present in the toner formulation as an extra particulate agent in the range of 0.1% to 2.0% by weight of the toner composition, including all values and increments in the range of 0.1% to 2.0% by weight. The medium silica may also be treated with surface additives that may impart different hydrophobic characteristics or different charges to the silica. For example, the silica may be treated with hexamethyldisilazane, polydimethylsiloxane (silicone oil), etc. Exemplary silicas may be available from Evonik Corporation under the tradename AEROSIL and product numbers RX-50 or RY-50.

Large colloidal silica may be understood as silica having a primary particle size in the range of greater than 70 nm, preferably between 70 nm to 120 nm, prior to any after treatment, including all values and increments therein. Most colloidal silicas are prepared as monodisperse suspensions with particle sizes ranging from approximately 30 nm to 150 nm in diameter. Polydisperse suspensions can also be synthesized and have roughly the same limits in particle size. Smaller particles are difficult to stabilize while particles much greater than 150 nm are subject to sedimentation. Whereas fumed silica tend to form agglomerates or aggregates, colloidal silica are dispersed more uniformly and in most cases dispersed as individual particles and have significantly fewer agglomerates or aggregates.

The large colloidal silica may be present in the toner formulation as an extra particulate agent in the range of 0.1 wt % to 2 wt %, for example in the range of 0.25 wt % to 1 wt % of the toner composition. The large colloidal silica may also be treated with surface additives that may impart different hydrophobic characteristics or different charges to the silica. For example, the large colloidal silica may be treated with hexamethyldisilazane, polydimethylsiloxane, dimethyldichlorosilane, and combinations thereof, wherein the treatment may be present in the range of 1 wt % to 10 wt % of the silica. An example of the large silica may be available from Cabot Corp. under the trade name TGC 110, or from Sukgyung AT Inc. under the trade name of SGSO100C.

The alumina ($Al_2O_3$) that may be used herein may have an average primary particle size in the range of 5 nm to 20 nm, including between 8 nm to 16 nm (largest cross-sectional linear dimension). In addition, the alumina may be surface treated with an inorganic/organic compound which may then improve mixing (e.g. compatibility) with organic based toner compositions. For example, the alumina may include an octylsilane coating. The alumina may be present in the range of 0.01% to 1.0% by weight of the toner composition, including all values and increments therein, such as in the range of 0.01% to 0.25%, or 0.05% to 0.10% by weight. An example of the aluminum oxide may be that available from Evonik Corporation under the tradename AEROXIDE and product number C 805.

Small silica may be understood as silica ($SiO_2$) having an average primary particle size in the range of 2 nm to 20 nm, or between 5 nm to 15 nm (largest cross-sectional linear dimension) prior to any after treatment, including all values and increments therein. The small silica may be present in the toner formulation as an extra particulate agent in the range of 0.1% to 0.5% by weight, including all values and increments therein. In addition, the small silica may be treated with hexamethyldisilazane. Exemplary small silica may be available from Evonik Corporation under the tradename AEROSIL and product number R812.

In addition, titania (titanium-oxygen compounds such as titanium dioxide) may be added to the toner composition as a extra particulate additive. The titania may be present in the formulation in the range of about 0.2% to 1.0% by weight, including all values and increments therein. The titania may include a surface treatment, such as aluminum oxide. The titania particles may have a mean particle length in the range of 1.0 μm to 3.0 μm, such as 1.68 μm and a mean particle diameter in the range of 0.05 μm to 0.2 μm, such as 0.13 μm. An example of titania contemplated herein may include FTL-110 available from ISK USA. The following examples are provided to further illustrate the teachings of the present disclosure, not to limit the scope of the present disclosure.

EXAMPLES

Example Yellow Pigment Dispersion

About 10 g of AKYPO RLM-100 polyoxyethylene(10) lauryl ether carboxylic acid from Kao Corporation, Bunka Sumida-ku, Tokyo, Japan was combined with about 350 g of de-ionized water and the pH was adjusted to ~7-9 using sodium hydroxide. About 10 g of Solsperse 27000 from Lubrizol Advanced Materials, Cleveland, Ohio, USA was added and the dispersant and water mixture was blended with an electrical stirrer followed by the relatively slow addition of 100 g of PY 74 pigment. Once the pigment was completely wetted and dispersed, the mixture was added to a horizontal media mill to reduce the particle size. The solution was processed in the media mill until the particle size was about 200 nm. The final pigment dispersion was set to contain about 20% to about 25% solids by weight.

Example Magenta Pigment Dispersion

About 10 g of AKYPO RLM-100 polyoxyethylene(10) lauryl ether carboxylic acid from Kao Corporation, Bunka Sumida-ku, Tokyo, Japan was combined with about 350 g of de-ionized water and the pH was adjusted to ~7-9 using sodium hydroxide. About 10 g of Solsperse 27000 from Lubrizol Advanced Materials, Cleveland, Ohio, USA was added and the dispersant and water mixture was blended with an electrical stirrer followed by the relatively slow addition of 100 g of Red 122 pigment. Once the pigment was completely wetted and dispersed, the mixture was added to a horizontal media mill to reduce the particle size. The solution was processed in the media mill until the particle size was about 200 nm. The final pigment dispersion was set to contain about 20% to about 25% solids by weight.

Example Cyan Pigment Dispersion

About 10 g of AKYPO RLM-100 polyoxyethylene(10) lauryl ether carboxylic acid from Kao Corporation, Bunka Sumida-ku, Tokyo, Japan was combined with about 350 g of de-ionized water and the pH was adjusted to ~7-9 using sodium hydroxide. About 10 g of Solsperse 27000 from Lubrizol Advanced Materials, Cleveland, Ohio, USA was added and the dispersant and water mixture was blended with an electrical stirrer followed by the relatively slow addition of 100 g of pigment blue 15:3. Once the pigment was completely wetted and dispersed, the mixture was added to a horizontal media mill to reduce the particle size. The solution was processed in the media mill until the particle size was about 200 nm. The final pigment dispersion was set to contain about 20% to about 25% solids by weight.

Example Rubline Pigment Dispersion

About 10 g of AKYPO RLM-100 polyoxyethylene(10) lauryl ether carboxylic acid from Kao Corporation, Bunka Sumida-ku, Tokyo, Japan was combined with about 350 g of de-ionized water and the pH was adjusted to ~7-9 using sodium hydroxide. About 10 g of Solsperse 27000 from Lubrizol Advanced Materials, Cleveland, Ohio, USA was added and the dispersant and water mixture was blended with an electrical stirrer followed by the relatively slow addition of 100 g of Red 185 pigment. Once the pigment was completely wetted and dispersed, the mixture was added to a horizontal media mill to reduce the particle size. The solution was processed in the media mill until the particle size was about 200 nm. The final pigment dispersion was set to contain about 20% to about 25% solids by weight.

Example Wax Emulsion

About 12 g of AKYPO RLM-100 polyoxyethylene(10) lauryl ether carboxylic acid from Kao Corporation, Bunka Sumida-ku, Tokyo, Japan was combined with about 325 g of de-ionized water and the pH was adjusted to ~7-9 using sodium hydroxide. The mixture was then processed through a microfluidizer and heated to about 90° C. About 60 g of paraffin and ester wax from Cytec Corp., Elizabethtown, Ky. was slowly added while the temperature was maintained at about 90° C. for about 15 minutes. The emulsion was then removed from the microfluidizer when the particle size was below about 300 nm. The solution was then stirred at room temperature. The wax emulsion was set to contain about 10% to about 18% solids by weight.

Example Low Tg Amorphous Polyester Resin Emulsion

A polyester resin having a peak molecular weight of about 11,000, a glass transition temperature (Tg) of about 55° C. to about 58° C., a melt temperature (Tm) of about 115° C., and an acid value of about 8 to about 13 was used. The glass transition temperature is measured by differential scanning calorimetry (DSC), wherein, in this case, the onset of the shift in baseline (heat capacity) thereby indicates that the Tg may occur at about 55° C. to about 58° C. at a heating rate of about 5 per minute. The acid value may be due to the presence of one or more free carboxylic acid functionalities (—COOH) in the polyester. Acid value refers to the mass of potassium hydroxide (KOH) in milligrams that is required to neutralize one gram of the polyester. The acid value is therefore a measure of the amount of carboxylic acid groups in the polyester.

150 g of the polyester resin was dissolved in 450 g of methyl ethyl ketone (MEK) in a round bottom flask with stirring. The dissolved resin was then poured into a beaker. The beaker was placed in an ice bath directly under a homogenizer. The homogenizer was turned on at high shear and 7 g of 10% potassium hydroxide (KOH) solution and 500 g of de-ionized water were immediately added to the beaker. The homogenizer was run at high shear for about 2-4 minutes then the homogenized resin solution was placed in a vacuum distillation reactor. The reactor temperature was maintained at about 43° C. and the pressure was maintained between about 22 inHg and about 23 inHg. About 500 mL of additional de-ionized water was added to the reactor and the temperature was gradually increased to about 70° C. to ensure that substantially all of the MEK was distilled out. The heat to the reactor was then turned off and the mixture was stirred until it reached room temperature. Once the reactor reached room temperature, the vacuum was turned off and the resin solution was removed and placed in storage bottles.

The particle size of the low Tg amorphous polyester resin emulsion was between about 190 nm and about 240 nm (volume average) as measured by a NANOTRAC Particle Size Analyzer. The pH of the resin solution was between about 7.5 and about 8.2.

Example High Tg Amorphous Polyester Resin Emulsion

A polyester resin having a peak molecular weight of about 15K, a glass transition temperature of about 59° C. to about 63° C., a melt temperature of about 119° C., and an acid value of about 20 to about 22 was used to form an emulsion using the procedure described in Example Low Tg Amorphous Polyester Resin Emulsion.

Example Crystalline Polyester Resin

A crystalline polyester resin having a glass transition temperature of about 82° C. a melt temperature of about 82° C., and an acid value of about 15 to about 18 was used to form an emulsion.

125 g of the crystalline polyester resin was dissolved in 375 g of tetrahydrofuran (THF) in a round bottom flask with heat and stirring. The dissolved resin was then poured into a beaker. The beaker was placed under a homogenizer. The homogenizer was turned on at high shear and 17 g of 10% potassium hydroxide (KOH) solution and 400 g of de-ionized water were immediately added to the beaker. The homogenizer was run at high shear for about 2-4 minutes then the homogenized resin solution was placed in a vacuum distillation reactor. The reactor temperature was maintained at about 43° C. and the pressure was maintained between about 22 inHg and about 23 inHg. About 500 mL of additional de-ionized water was added to the reactor and the temperature was gradually increased to about 60° C. to ensure that substantially all of the MEK was distilled out. The heat to the reactor was then turned off and the mixture was stirred until it reached room temperature. Once the reactor reached room temperature, the vacuum was turned off and the resin solution was removed and placed in storage bottles.

The particle size of the crystalline polyester resin emulsion was between about 185 nm and about 235 nm (volume average) as measured by a NANOTRAC Particle Size Analyzer. The pH of the resin solution was between about 8.6.

TONER FORMULATION EXAMPLES

Example Toner 1

The Example Crystalline Polyester Resin Emulsion, the Example Low Tg Amorphous Polyester Resin Emulsion and the Example High Tg Amorphous Polyester Resin Emulsion are used in a ratio of 5:55:40 (wt), with a core to shell ratio of 60:40 (wt.). The Example Crystalline Polyester Emulsion is combined with the Example Low Tg Amorphous Polyester Resin Emulsion to form the core while the Example High Tg Amorphous Polyester Resin Emulsion forms the shell. Components were added to a 2.5 liter reactor in the following relative proportions: 4 parts (polyester by weight) of the Example Crystalline Polyester Emulsion, 44 parts (polyester by weight) of the Example Low Tg Polyester Resin Emulsion, 5.1 parts (pigment by weight) of the Example Cyan Pigment Dispersion, 14.2 parts (release agent by weight) of the Example Wax Emulsion. Deionized water was then added so that the mixture contained about 12% to about 15% solids by weight.

The mixture was heated in the reactor to 25° C. and a circulation loop was started consisting of a high shear mixer and an acid addition pump. The mixture was sent through the loop and the high shear mixer was set at 10,000 rpm. Acid was slowly added to the high shear mixer to evenly disperse the acid in the toner mixture so that there were no pockets of low pH. Acid addition took about 4 minutes with 210 g of 1% sulfuric acid solution. The flow of the loop was then reversed to return the toner mixture to the reactor and the temperature of the reactor was increased to about 40-45° C. Once the particle size reached 4.05 μm to 5.0 μm (number average), 5% (wt.) borax solution (20 g of solution having 1.0 g of borax) was added. After the addition of borax, 32 parts (polyester by weight) of the Example High Tg Amorphous Polyester Resin Emulsion was added to form the shell. The mixture was stirred for about 5 minutes and the pH was monitored. Once the particle size. reached 5.5 μm (number average), 4% NaOH was added to raise the pH to about 6.89 to stop the particle growth. The reaction temperature was held for one hour. The particle size was monitored during this time period. Once particle growth stopped, the temperature was increased to 82° C. to cause the particles to coalesce. This temperature was maintained until the particles reached their desired circularity (about 0.97). The toner was then washed and dried.

The dried toner had a volume average particle size of 6.26 μm, measured by a COULTER COUNTER Multisizer 3 analyzer and a number average particle size of 5.28 μm. Fines (<2 μm) were present at 0.50% (by number) and the toner possessed a circularity of 0.985, both measured by the SYSMEX FPIA-3000 particle characterization analyzer, manufactured by Malvern Instruments, Ltd., Malvern, Worcestershire UK.

The Toner was placed in a CYCLOMIX along with about 0.75% by weight of small silica such as Aerosil R812 from Evonik Corporation, an alumina about 0.10% by weight alumina such as Aeroxide C805 from Evonik Corporation, 2.0% of silica RY50 from Evonik Corporation and 0.5% titania FTL-110 from Ishihara Sangyo Kaisha, Ltd. and 0.5% of large silica such as SGSO100CDM8 from Sukgyung AT Inc. The CYCLOMIX was run for about 90 seconds. Subsequently the finished toner was evaluated.

Example Toner 2

The Example Crystalline Polyester Resin Emulsion, the Example Low Tg Amorphous Polyester Resin Emulsion and the Example High Tg Amorphous Polyester Resin Emulsion are used in a ratio of 7:53:40 (wt), with a core to shell ratio of 60:40 (wt.). The Example Crystalline Polyester Emulsion is combined with the Example Low Tg Amorphous Polyester Resin Emulsion to form the core while the Example High Tg Amorphous Polyester Resin Emulsion forms the shell. Components were added to a 2.5 liter reactor in the following relative proportions: 5.4 parts (polyester by weight) of the Example Crystalline Polyester Emulsion, 41.3 parts (polyester by weight) of the Example Low Tg Polyester Resin Emulsion, 6 parts (pigment by weight) of the Example Magenta Pigment Dispersion, 2 parts (pigment by weight) of the Example Rubline Pigment Dispersion, 14.2 parts (release agent by weight) of the Example Wax Emulsion. Deionized water was then added so that the mixture contained about 12% to about 15% solids by weight.

Toner 2 was made the following the same procedure as outlined above to make Toner 1, except that Toner 2 used 31 parts (polyester by weight) of the Example High Tg Amorphous Polyester Resin Emulsion to make the shell.

The dried toner had a volume average particle size of 6.11 μm and a number average particle size of 5.22 μm. Fines (<2 μm) were present at 2.50% (by number) and the toner possessed a circularity of 0.985.

Example Toner 3

The Example Crystalline Polyester Resin Emulsion, the Example Low Tg Amorphous Polyester Resin Emulsion and the Example High Tg Amorphous Polyester Resin Emulsion are used in a ratio of 5:65:30 (wt), with a core to shell ratio of 70:30 (wt.). The Example Crystalline Polyester Emulsion is combined with the Example Low Tg Amorphous Polyester Resin Emulsion to form the core while the Example High Tg Amorphous Polyester Resin Emulsion forms the shell. Components were added to a 2.5 liter reactor in the following relative proportions: 4 parts (polyester by weight) of the Example Crystalline Polyester Emulsion, 51 parts (polyester by weight) of the Example Low Tg Polyester Resin Emulsion, 7 parts (pigment by weight) of the Example Yellow Pigment Dispersion, 14.2 parts (release agent by weight) of the Example Wax Emulsion. Deionized water was then added so that the mixture contained about 12% to about 15% solids by weight.

Toner 3 was made the following the same procedure as outlined above to make Toners 1 and 2, except that Toner 3 used 24 parts (polyester by weight) of the Example High Tg Polyester Resin Emulsion to form the shell.

The dried toner had a volume average particle size of 5.84 μm and a number average particle size of 5.10 μm. Fines (<2 μm) were present at 2.08% (by number) and the toner possessed a circularity of 0.986.

Example Control Toner I

In the control toner, no crystalline polyester resin is used in the toner formulation. The Example Low Tg Amorphous Polyester Resin Emulsion and the Example High Tg Amorphous Polyester Resin Emulsion are used in a ratio of 60:40 (wt). Components were added to a 2.5 liter reactor in the following relative proportions: 48.3 parts (polyester by weight) of the Example Low Tg Polyester Resin Emulsion, 5.1 parts (pigment by weight) of the Example Cyan Pigment Dispersion, 14.2 parts (release agent by weight) of the Example Wax Emulsion. Deionized water was then added so that the mixture contained about 12% to about 15% solids by weight.

The Control Toner was made using the same method used to make Toners 1 through 3, except that the Control Toner used 32.2 parts (polyester by weight) of the Example High Tg Polyester Resin Emulsion to form the shell.

The dried toner had a volume average particle size of 6.13 μm, measured by a COULTER COUNTER Multisizer 3 analyzer. Fines (<2 μm) were present at 3.95% (by number) and the toner possessed a circularity of 0.977, both measured by the SYSMEX FPIA-3000 particle characterization analyzer, manufactured by Malvern Instruments, Ltd., Malvern, Worcestershire UK.

Accordingly, it can be seen that the emulsion aggregation process used to prepare Example Toners 1, 2 and 3, which included a plasticizing agent consisting of a crystalline polyester resin in the core, significantly reduced the percentage of fine particles in comparison with the Control Toner. Furthermore, Example Toners 1, 2 and 3 possessed better circularity compared to the Control Toner.

Test Results

A toner's fusing properties include its fuse window. The fuse window is the range of temperatures at which fusing is satisfactorily conducted without incomplete fusion and without transfer of toner to the heating element, which may be a roller, belt or other member contacting the toner during fusing. Thus, below the low end of the fuse window the toner is incompletely melted and above the high end of the fuse window the toner flows onto the fixing member where it mars subsequent sheets being fixed. It is preferred that the low end of the fuse window be as low as possible to reduce the required temperature of the fuser in the electrophotographic printer to improve the printer's safety and to conserve energy. Another toner property that is measured is called the Ship to Store property. Toner must be able to survive the temperature and humidity extremes associated with storage and shipping without caking or blocking which may result in print flaws. As a result, the low end of the fuse window cannot be so low that the toner could melt during the storing or shipping of a toner cartridge containing the toner.

Fusing Window

Each toner composition was used to print 24# Hammermill laser paper (HMLP) using a fusing robot at 60 pages per minute (ppm) with a toner coverage of 1.1 mg/cm$^2$ employing various fusing temperatures as shown in Tables 1 and 2 below. The temperatures indicated in Tables 1 and 2 are the temperatures of the fusing robot's heating element/heater. For each toner composition, various fuse grade measurements were performed. These fuse grade measurements include a scratch resistance test shown in Table 1 and a conventional 60 degree gloss test shown in Table 2. For the scratch resistance test, the printed samples were evaluated using a TABER ABRADER device from TABER Industries, North Tonawanda, N.Y., USA. The printed samples were evaluated on the TABER ABRADER scale from 0 to 10 (where a rating of 10 indicates the most scratch resistance). The TABER ABRADER device scratches the printed samples multiple times with different forces until the toner is scratched off the sample. The point at which the toner is scratched off corresponds with a number rating between 0 and 10 on the TABER ABRADER scale. As is known in the art, the conventional 60 degree gloss test includes shining a known amount of light at the surface of the printed sheet at a 60 degree angle and measuring its reflectance. A higher gloss test value indicates that more energy was transferred to the substrate when it moved through the fuser. The gloss of the print also relates to the resin and release agent used in the toner.

TABLE 1

Scratch Test

| Fusing Temp. (° C.) | Control Toner | Toner 1 | Toner 2 | Toner 3 |
|---|---|---|---|---|
| 160 | — | CO | CO | CO |
| 165 | CO | 7.3 | 7.3 | 3.7 |
| 170 | 7 | 10 | 10 | 10 |
| 175 | 6.7 | 10 | 10 | 10 |
| 180 | 7 | 10 | 10 | 10 |
| 185 | 9.7 | 10 | 10 | 10 |
| 190 | 10 | 10 | 10 | 10 |
| 195 | 10 | 10 | 10 | 10 |
| 200 | 10 | 10 | 10 | 10 |
| 205 | 10 | 10 | 10 | 10 |
| 210 | 10 | 10 | 10 | 10 |
| 215 | 10 | 10 | 10 | 10 |
| 220 | 10 | 10 | 10 | 10 |
| 225 | 10 | 10 | 10 | 10 |
| 230 | 10 | 10 | 10 | 10 |

TABLE 2

Gloss Test

| Fusing Temp. (° C.) | Control Toner | Toner 1 | Toner 2 | Toner 3 |
|---|---|---|---|---|
| 160 | — | — | — | — |
| 165 | 10.2 | 13.4 | 10 | 14 |
| 170 | 12.1 | 13.4 | 12.4 | 17.2 |
| 175 | 12.1 | 15.8 | 13.2 | 16.6 |
| 180 | 12.1 | 16.9 | 13.2 | 19.9 |
| 185 | 14.3 | 18.9 | 16.6 | 20 |
| 190 | 16.3 | 21.8 | 18.3 | 25.1 |
| 195 | 17.5 | 24 | 20.9 | 26.7 |
| 200 | 18.3 | 24.9 | 22.4 | 29.5 |
| 205 | 20.4 | 25.4 | 23.5 | 30.5 |
| 210 | 23.1 | 27.6 | 25.7 | 27.9 |
| 215 | 24.2 | 30.3 | 27.2 | 25.4 |
| 220 | 27.1 | 31 | 29.9 | 23.2 |
| 225 | 23.8 | 24 | 30.7 | 21.9 |
| 230 | 23 | 15.5 | 33.2 | 20.3 |

As shown in Table 1, Toners 1, 2 and 3 having a crystalline polyester resin as a plasticizing agent in the core exhibited superior fusing performance compared to the Control Toner having no crystalline polyester plasticizing agent in the core. The low ends of the fusing windows for Toners 1, 2 and 3 were lower than the low ends of the fusing windows for the Control Toner. Specifically, Toners 1, 2 and 3 provided acceptable scratch resistance at temperatures as low as 165° C. The Control Toner was unable to provide acceptable scratch resistance at this temperature and instead showed cold offset ("CO"), which means the toner failed to fuse to the paper. Accordingly, less energy was required to accomplish an acceptable fusing operation for Toners 1, 2 and 3 than the Control Toner.

Additionally as shown in Table 2, the Control Toner showed poorer gloss values in comparison with Toners 1, 2 and 3 having the crystalline polyester resin as a plasticizing agent. Gloss results for Toners 1, 2 and 3 are in the acceptable range while the gloss result for the Control toner reveals an undesirable glossier toner compared to Toners 1, 2 and 3.

Accelerated Ship/Store Test

The accelerated ship/store test involves using 8 gm of toner, place in a container, with a 75 gm load placed over it. System is then subjected to the required temperature under evaluation, for 48 hrs. Torque is measured using a probe and value shown corresponds to the resistance offered by the toner sample to the probe, units are in gradient/sec. Typically the lower the value the better. A high $60^{th}$ value is considered failure of the test. Under the current ship/store test conditions, Toners 1, 2 and 3 all passed the ship/store test—scoring 52, 54 and 52, respectfully, This is important because Toners 1, 2 and 3 all had better fusing results than the Control Toner and passed the ship/store test.

The foregoing description of several embodiments has been presented for purposes of illustration. It is not intended to be exhaustive or to limit the application to the precise forms disclosed, and obviously many modifications and variations are possible in light of the above teaching. It is understood that the invention may be practiced in ways other than as specifically set forth herein without departing from the scope of the invention. It is intended that the scope of the application be defined by the claims appended hereto.

What is claimed is:

1. A chemically prepared toner composition, comprising:

a core including a first polymer binder, a second polymer binder, a colorant and a release agent;

a shell including a third polymer binder formed around the outer surface of the core; and a borax coupling agent between the core and the shell, wherein the borax coupling agent assists in adhering the shell to the outer surface of the core.

2. The chemically prepared toner composition of claim 1, wherein the first polymer binder, the second polymer binder and the third polymer binder each include a polyester resin.

3. The chemically prepared toner composition of claim 2, wherein the first polymer binder is an amorphous polyester resin.

4. The chemically prepared toner composition of claim 2, wherein the second polymer binder is a crystalline polyester resin.

5. The chemically prepared toner composition of claim 2, wherein the third polymer binder is an amorphous polyester resin.

6. The chemically prepared toner composition of claim 2, wherein the first polymer binder and the third polymer binder are different amorphous polyester resins.

7. The chemically prepared toner of claim 1 further comprising extra particulate additives selected from the group consisting of medium sized silica particles a primary particle size in the range of 30 nm to 60 nm, large sized silica particles having a primary particle size in the range of 90 nm 120 nm, small sized silica particles having a primary particle size in the range of 2 nm to 20 nm, alumina particles and titania particles.

8. The toner composition of claim 7, wherein said medium sized silica particles are treated with a surface treatment selected from the group consisting of hexamethyldisilazane and polydimethylsiloxane.

9. The toner composition of claim 7, wherein said large sized silica particles are treated with a surface treatment selected from the group consisting of hexamethyldisilazane, polydimethylsiloxane, dimethyldichlorosilane, dimethyldiethoxysilane octyltrialkoxysilane and combinations thereof.

10. The toner composition of claim 7, wherein said alumina particles are surface treated with octylsilane.

11. The chemically prepared toner composition of claim 1, wherein the ratio of the first polymer binder and the second polymer binder to the third polymer binder is between about 20:80 and about 80:20 by weight.

12. The chemically prepared toner composition of claim 11, wherein the ratio of the first polymer binder and the second polymer binder to the third polymer binder the ratio of the first polymer binder to the second polymer binder is between about 50:50 and about 70:30 by weight.

* * * * *